United States Patent [19]

Matsuda

[11] Patent Number: 5,069,562

[45] Date of Patent: Dec. 3, 1991

[54] CONTINUOUS PAPER AUTOLOADING MECHANISM FOR THERMAL PRINTER

[75] Inventor: Yasuhiko Matsuda, Iwate, Japan

[73] Assignee: Kabushiki Kaisha Sato, Japan

[21] Appl. No.: 559,261

[22] Filed: Jul. 30, 1990

[30] Foreign Application Priority Data

Aug. 24, 1989 [JP] Japan ..... 1-098799[U]

[51] Int. Cl.[5] ..... B41J 3/00; B65H 25/00

[52] U.S. Cl. ..... 400/120; 400/88; 400/630; 400/708; 101/288; 156/542

[58] Field of Search ..... 400/120, 70, 708, 88, 400/630, 631; 101/220, 382.1, 288; 156/540–543

[56] References Cited

U.S. PATENT DOCUMENTS

| | | | |
|---|---|---|---|
| 4,422,376 | 12/1983 | Teraoka | 101/382.1 |
| 4,578,140 | 3/1986 | Nakajima | 156/540 |
| 4,615,631 | 10/1986 | Ueda et al. | 400/70 |
| 4,639,287 | 1/1987 | Sakura | 156/542 |
| 4,647,235 | 3/1987 | Sato | 156/542 |
| 4,844,629 | 7/1989 | Hoyt | 400/708 |
| 4,920,882 | 5/1990 | Hoyt | 400/708 |

FOREIGN PATENT DOCUMENTS

| | | | |
|---|---|---|---|
| 0026986 | 2/1977 | Japan | 101/220 |
| 0138655 | 8/1983 | Japan | 400/76 |

*Primary Examiner*—Eugene H. Eickholt

*Attorney, Agent, or Firm*—Ostrolenk, Faber, Gerb & Soffen

[57] ABSTRACT

A continuous paper autoloading mechanism for a thermal printer comprises a continuous paper supply section, a paper feeder, a pitch sensor for detecting the pitch of labels or tags detachably attached to the continuous paper and for producing pitch signals, a paper guide and a printer section having a paper feeding capability, all disposed in succession in the direction of paper feed. The paper feeding functions provided by the paper feeder and the printer section are synchronized and controlled in response to the pitch signals for feeding the leading edge of a first label on the continuous paper into proper alignment with the printer head, in a manner which avoids wastage of labels and carbon ribbon during the autoloading process.

12 Claims, 2 Drawing Sheets

CONTINUOUS PAPER AUTOLOADING MECHANISM FOR THERMAL PRINTER

BACKGROUND OF THE INVENTION

The present invention relates to a thermal printer having a thermal head and a platen for printing information on continuous paper which holds labels, tags or the like, and more particularly relates to a paper autoloading mechanism which prevents wastage of paper, at the start of the printing process.

DESCRIPTION OF BACKGROUND ART

In thermal printers of the type referred to above, the driving power for feeding the continuous paper is conventionally provided solely through rotation of the platen roller, which platen roller is in pressure contact with the thermal head. To set the position of the continuous paper with respect to the printing section of the printer, the leading end of the continuous paper which has been previously loaded in the paper supply section of the printer is grasped between the fingers, passed through a label pitch sensor located between the paper supply section and the printer section, and inserted into the printer section The printer section serves both to imprint information on and to feed (draw) the continuous paper.

After the continuous paper has been set manually in this manner, it is necessary to properly align the leading end of the first label or tag of the continuous paper with the printer section. To this end, when the printer is turned on, the platen roller is rotated to feed the paper until the label pitch sensor outputs a pitch detection signal which indicates that the leading end of the label or tag has been properly aligned.

Because of the relative positions of the printer section, the label pitch sensor, and the leading end of the labels or tags, the first one or two labels or tags on the continuous paper are invariably conveyed past the printer head and are thus wasted.

SUMMARY OF THE INVENTION

Accordingly, it is an object of the present invention to provide a continuous paper autoloading mechanism for a thermal printer capable of properly aligning continuous paper at the start of printing so that label wastage is avoided.

The foregoing and other objects of the present invention are realized by a mechanism which does not rely on the platen roller as the sole means of feeding the paper. Rather, a further paper feeding means is provided in the vicinity of the continuous paper supply section. This further paper feeding means is constructed to operate synchronously with the platen roller.

More specifically, the invention provides a continuous paper autoloading mechanism for a thermal printer comprising a continuous paper supply section, a paper feeding means, a pitch sensor for detecting the pitch of labels or tags of the continuous paper and for producing pitch signals, a paper guide and a printing means which includes paper feeding means. The foregoing elements are disposed in succession, in the direction of paper feed. The paper feeding operation of the paper feeding means and of the printing means are synchronized and controlled in response to the pitch signals to feed the leading edge of the continuous paper into proper alignment with the printing means.

The continuous paper used with the autoloading mechanism according to this invention is in the form of a continuous strip on which labels or tags are serially disposed. A segment of a label strip is shown in FIG. 2, by way of example. The continuous paper (label strip) 1 comprises a tape-like backing sheet 4 having labels 2 attached thereon at regular intervals. As shown in FIG. 1, the continuous paper 1 is wound on a supply reel disposed at a supply section 6. Alternatively, the continuous paper 1 can be in the form of a strip of continuous tags which are separated by perforations for being easily detached from one another, avoiding the need for a backing sheet.

The manual phase of the paper loading process consists of feeding the leading end of the continuous paper 1 between the rollers 11 and 12 of a feeding means and pressing an autofeed button (not shown).

Pressing the autofeed button starts a pulse motor 10 which rotates both the feed roller 11 of the feeding means and also the platen roller 14. The continuous paper 1 is thus advanced (autoloaded) and, simultaneously, the thermal head 15 is raised. In the raised position of the thermal head 15, little or no traction exists between the platen roller 14 and a carbon ribbon 7 that passes over it. Consequently, fresh carbon ribbon is not fed during the initial feeding and alignment of the continuous paper 1. This saves carbon ribbon.

When the continuous paper 1 is fed forwardly by the feed roller 11, its leading end is detected by a pitch sensor 18 located at an intermediate position of a paper guide 19 which forms a feed path for the continuous paper 1. The detection signal from the pitch sensor 18 is supplied to a microcomputer (not shown) in the memory of which is stored a value corresponding to the distance L between the pitch sensor 18 and the printing means. It is noted that when the paper arrives at the printing section, the platen roller 14 is used to press the paper against the thermal head 15. Upon receiving the detection signal, the microcomputer 10 outputs to the pulse motor 10 a value corresponding to the number of feed pulses needed to move the paper by the distance L. This starts the paper moving toward the printing section.

Next, the pitch sensor 18 detects the pitch of the labels of the continuous paper 1, that is the distance l between adjacent detection marks, holes or the like which enable the device to distinguish the labels from one another. Specifically, the microcomputer counts the number of feed pulses outputted to move the paper between the first and second detection marks. The result is stored as the label or tag pitch of the particular continuous paper 1. This enables the device to operate with differently sized labels or tags.

Upon determination of the label pitch, the number of feed pulses Pb corresponding to the detected label pitch is subtracted from the number of feed pulses Pa corresponding to the distance between the pitch sensor 18 and the printing means. The subtraction result is stored in the microcomputer memory. Thereby the number of feed pulses Pc needed to further feed the continuous paper 1 so as to cause the leading edge of the first label to be properly aligned with the printing means is obtained.

The microcomputer outputs the number of pulses Pc to the motor 10, thus completing the initial setting of the continuous paper 1. After the continuous paper 1 has been to be in correct alignment with the printing means in this manner, an electromagnet 17 is de-energized.

This allows the thermal head 15 to return to its normal position and to clamp the continuous paper 1 between itself and the platen roller 14. This completes the autoloading operation.

Other features and advantages of the present invention will become apparent from the following description of the invention which refers to the accompanying drawings.

BRIEF DESCRIPTION OF THE DRAWINGS o

DETAILED DESCRIPTION OF THE PREFERRED EMBODIMENT

The invention is explained below with reference to FIG. 1 which shows the overall arrangement of the autoloading mechanism. FIG. 2 shows a continuous paper which holds sequentially arranged labels.

In the case of the continuous paper having the labels 2 shown in FIG. 2, the individual labels 2 are coated on their rear sides with an adhesive 3 by which they are detachably attached to the backing sheet 4. The distance l between successive spaces or marks 5 separating the labels 2 from each other is defined as the label pitch.

Figure 1:
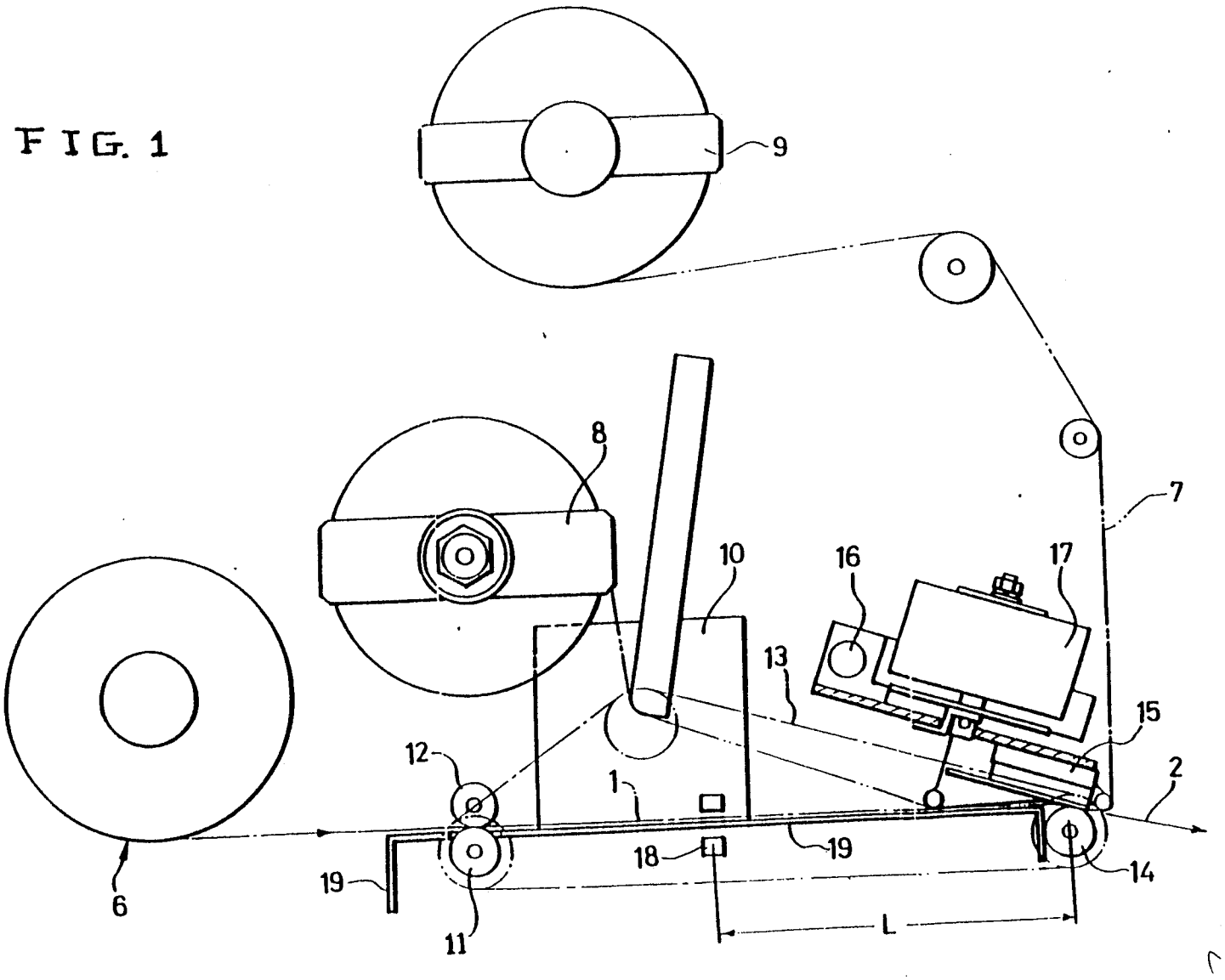
FIG. 1 is a schematic view of a thermal printer having an autoloading mechanism according to the present invention.
Figure 2:
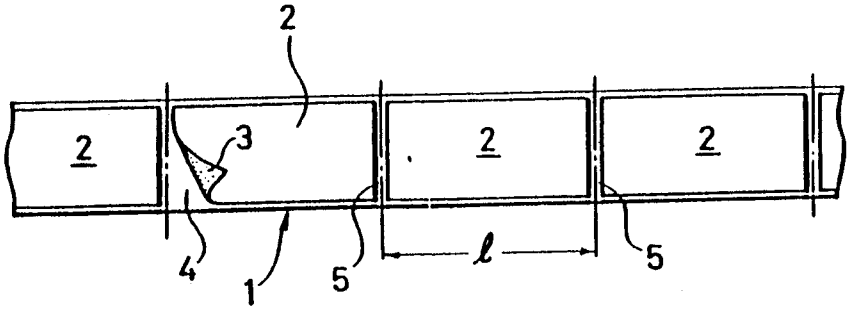
FIG. 2 is a plan view of a section of an exemplar of a continuous label strip, usable with the autoloading mechanism according to this invention.

Referring to FIG. 1, the continuous paper 1 is wound on a supply reel or the like and loaded into a supply section 6. The continuous paper 1 is led from the supply section 6 through a continuous paper feeding means constituted of a feed roller 11 and a pressure roller 12 which resiliently bears against the feed roller 11. The paper then passes through a to-be-described pitch sensor 18 and is thereafter guided through a printing means constituted by a platen roller 14 and a thermal head 15.

A carbon ribbon 7 is paid out of a supply reel 8. It passes over guides (unnumbered) on its way to the printing means, where the ribbon 7 comes into intimate contact with the continuous paper 1. It then continues on to a take-up reel 9.

The paper feeding means 11,12 and the platen roller 14 of the printing means are synchronously driven by a pulse motor 10 via a timing belt 13.

The thermal head 15 is pivotally supported by a pin 16 about which it can swing upward by magnetic attraction provided through energization of an electromagnet 17 positioned immediately above it. In its raised position, the thermal head 15 is separated from the platen roller 14 that normally presses against it and which forms with it a label path.

The pitch sensor 18 is located between the feed roller 11 of the feeding means and the platen roller 14 of the printing means. Put another way, the feeding means for the continuous paper 1 is positioned between the pitch sensor 18 and the continuous paper supply section 6. To ensure reliable guiding of the continuous paper 1, a paper guide 19 extends from immediately upstream of the feeding means 11,12 to immediately upstream of the printing means 14,15.

More precisely, the pitch sensor 18 is positioned in the vicinity of the feeding means 11,12, at a distance L from the printing means, with L being greater than the aforesaid label pitch l.

The pitch sensor 18 depicted in FIG. 2 is a transmission type sensor consisting of a light emitting element and a light receiving element, the two elements facing one another across the path of the continuous paper 1. The output of the pitch sensor 18 (specifically, the light receiving element) has three levels: (1) a high level produced when no label is present in the light path, (2) a medium level produced when only the backing sheet 4 is present within the light path (this occurs when the leading end of the continuous paper, which precedes the first label, or a portion of the continuous paper between labels, is disposed between the sensor elements), and (3) a low level produced when a double layer consisting of the backing sheet 4 and the label 2 is within the light path. The device of the present invention is able to distinguish between these three states.

The operation of the autoloading mechanism is as follows.

First, the pressure roller 12 which normally presses against the feed roller 11 is raised and the leading end of the wound continuous paper 1 which is loaded in the supply section 6 is set between the two rollers. The pressure roller 12 is then allowed to resume its normal position at which it clamps the leading end, i.e. the header, of the continuous paper 1 between itself and the feed roller 11.

Next, an autofeed button (not shown) is pressed to start the pulse motor 10. The rotation of the pulse motor 10 is transmitted via the timing belt 13 to the feed roller 11. As a result, the continuous paper 1 is controllably autofed between the feed roller 11 and the pressure roller 12. Simultaneously, the electromagnet 17 is energized whereby the thermal head 15 is raised and the otherwise clamped carbon ribbon 7 between the thermal head 15 and the platen roller 14 is released. This prevents unnecessary and wasteful feeding of the carbon ribbon 7 during the loading operation.

Since the feed roller 11 of the feeding means and the platen roller 14 of the printing means are interlinked and both are driven by the pulse motor 10 through the timing belt 13, the system can be controlled with a microcomputer to feed the paper by the feeding means 11,12 and by the platen roller 15 at the same speed.

Rotation of the feed roller 11 causes the leading end of the continuous paper 1 to be fed out and to be guided by the paper guide 19 toward the print head 14. In time, the leading edge of the first label attached to the backing sheet 4 thereof is detected by the pitch sensor 18.

More precisely, the pitch sensor 18 produces at first the high level output as no continuous paper is detected. This output falls to the medium level when the backing sheet 4 header reaches the sensor 18, and finally falls to the low level when the leading edge of the first label reaches the sensor. Thus, the leading edge of the first label is detected when the output of the pitch sensor 18 changes from the medium to the low level.

The distance L from the pitch sensor 18 to the printing means 14,15, specifically the printing position at which the platen roller 14 presses onto the thermal head 15, is stored in the microcomputer in advance. Once the pitch sensor 18 detects the leading edge of the continuous paper 1, the microcomputer outputs to the pulse motor 10 just enough feed pulses to move the paper 1 by the distance L.

Next the pitch sensor 18 detects the distance l which is equivalent to the distance from the space 5 of the first label to the space 5 of the next label. This distance is the label pitch.

Since the labels are not present at the spaces 5 on the backing sheet 4, as the first space 5 and then the leading edge of the second label pass by the pitch sensor 18, the output of the pitch sensor 18 changes from the low to the medium level and then back to the low level. Thus, the leading edge of the second label can be detected from the falling signal level.

The microcomputer counts the number of feed pulses produced between the detection of the leading edges of the first and second labels and stores the count as the label pitch value of the continuous paper which is presently loaded in the thermal printer.

After the label pitch is detected, the number of feed pulses Pb corresponding to the detected label pitch is subtracted from the number of feed pulses Pa corresponding to the distance L between the pitch sensor 18 and the printing means 14,15. The subtraction result designated as the value Pc is immediately stored in the microcomputer memory. The value Pc represents the number of feed pulses pc required to further feed the continuous paper 1 so as to cause the leading edge of the first label to be exactly aligned with the printing means 14,15.

The microcomputer outputs the number of pulses Pc to the motor 10 and thus completes the initial setting of the continuous paper 1. After the continuous paper 1 has been advanced for proper alignment at the printing means in this manner, the electromagnet 17 is de-energized, causing the thermal head 15 to return to its normal position to clamp the continuous paper 1 between itself and the platen roller 14. This completes the autoloading operation.

It will be understood that while the thermal head 15 is in the raised position there is little or no friction between the carbon ribbon 7 and the platen roller 14 so that the carbon ribbon 7 is not fed forward, even though the platen roller 14 is rotated synchronously with the feed roller 11 during alignment of the first label with the printing means. This avoids wastage of the carbon ribbon.

The invention is not necessarily limited to only such arrangements in which the spaces 5 are used to detect the label pitch. Alternatively, the surface of the tape-like backing sheet can be provided with detection marks whose reflectance differs from that of the other surfaces of backing sheet. In this case a reflection type pitch sensor is used and the label pitch is sensed as the interval between changes in output caused either by transition from a detection mark to the backing sheet or vice versa. If detection marks are not located at the leading edges of the respective labels, the distance between each detection mark and the leading edge of the associated label is taken into consideration in controlling feeding of the labels 5.

It was stated above that the distance L between the platen roller 14 and the pitch sensor 18 is greater than the label pitch l, i.e. the label length or repetition distance. However the invention is not necessarily limited in this manner. Even if the distance L is shorter than the distance l, autofeeding is still possible if two conditions are met. The first of these is that the label pitch data be stored in the memory of the microcomputer in advance and the second that a distance l′ (not shown) between each detection mark and the leading edge of the associated label be smaller than the distance L, i.e. (l′ is smaller than L). In this case, the label pitch data stored in the microcomputer in advance corresponds to the number of feed pulses of the pulse motor 10 needed to advance the paper by the distance L−l′.

During an autofeed operation, the stored data is read out upon detection of the detection mark by the pitch sensor 18 and the paper feeding operation is continued by an amount corresponding to the read-out data, whereby the leading edge of the first label of the continuous paper 1 is fed into proper alignment with the printing means.

In the foregoing embodiment, in which the portions of the backing sheet of the continuous paper 1 located between the labels constitute the detection marks, the distance l is zero so that the label pitch data to be stored in advance in the microcomputer memory is the number of feed pulses corresponding to the distance L.

As explained above, in the present invention, the means for feeding the continuous paper is not constituted solely by the platen roller of the printing means but also by a separate feeding means provided in the vicinity of the continuous paper supply section 6. More specifically, the autoloading mechanism comprises a continuous paper supply section, a paper feeding means, a pitch sensor and a printing means, disposed in the order mentioned, in the direction of paper feed. The feeding operation of the paper feeding means is synchronized with that of the printing means 14,15. As a result, when a fresh reel of the continuous paper is loaded into the thermal printer employing this invention, the first label, tag or the like of the continuous paper can be automatically aligned with the printing means, whereby continuous paper is not wasted.

Further, since the paper guide 19 extends at least from the feeding means 11,12, past the pitch sensor 18, and to the printing means 14,15, the continuous paper 1 can be reliably fed and guided.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A continuous paper autoloading mechanism for a thermal printer, the autoloading mechanism comprising:

a continuous paper supply section, a paper feeding means for feeding continuous paper from the supply section, a pitch sensor for detecting a pitch of labels or tags associated with the continuous paper and for producing pitch signals, and a printing means for printing information on the labels or tags, the printing means including means for feeding the continuous paper, the continuous paper supply section, the paper feeding means, the pitch sensor and the printing means being disposed in succession in the direction of paper feed, feeding of the continuous paper by the paper feeding means and the printing means being synchronized and controlled in response to the pitch signals and being effective for feeding a leading edge of the continuous paper into proper alignment with the printing head.

2. A continuous paper autoloading mechanism for a thermal printer, the autoloading mechanism comprising:

a continuous paper supply section for holding and supplying a continuous paper comprising labels or tags;

a paper feeding means;

a pitch sensor for detecting a pitch of the labels or tags and for producing pitch signals;

a printing means for imprinting information on the labels or tags;

the paper feeding means, the pitch sensor and the printing means being disposed in succession in a direction of paper feed; and control means, responsive to the pitch signals, for controlling the paper feeding means to feed the continuous paper such that a leading edge of a first label or tag becomes aligned with a printing position associated with the printing means.

3. The autoloading mechanism of claim 2, wherein the pitch sensor is located at the predetermined distance L from the printing position and wherein the control means is effective, in response to the pitch signals, to first detect a leading end of the continuous paper and then advance the continuous paper by the distance L to convey the leading end to the printing position.

4. The autoloading mechanism of claim 3, wherein the control means is also effective, in response to the pitch signals, to further advance the continuous paper by a distance which is equal to the distance L less the label pitch.

5. The autoloading mechanism of claim 3, wherein the printing means comprises a print head and a rotatable platen, means for selectively engaging and disengaging the print head and the rotatable platen from one another, the control means being effective to maintain said print head and rotatable platen disengaged from one another at least until a leading edge of a first label has reached the printing position whereby wastage of carbon ribbon drawn by the printing section when the print head and the rotatable platen are engaged with one another is avoided.

6. The autoloading mechanism of claim 5, further comprising means for driving the paper feeding means and the rotatable platen synchronously with one another.

7. The autoloading mechanism of claim 6, wherein the control means is effective for generating feed pulses to drive the paper feeding means and the rotatable platen.

8. The autoloading mechanism of claim 7, wherein a number representative of feed pulses corresponding to the predetermined distance L is stored in a memory of the control means.

9. The autoloading mechanism of claim 8, wherein a number representative of feed pulses corresponding to a further distance which equals the predetermined distance less the label pitch is stored in the memory.

10. The autoloading mechanism of claim 3, wherein the pitch signals have associated therewith first, second and third levels, corresponding respectively to the nonpresence of any portion of the continuous paper at the pitch sensor, the presence only of a backing sheet component of the continuous paper at the pitch sensor, and the presence at the pitch sensor of a portion of the continuous paper which comprises both the back sheet and a label or tag attached thereto.

11. The autoloading mechanism of claim 3, wherein the pitch sensor is effective to detect detection marks on a backing sheet of the continuous paper whose reflectance differs from other surfaces of the continuous paper.

12. The autoloading mechanism of claim 3, wherein a value corresponding to a first distance from the pitch sensor to the printing position is stored in a memory of the control means and a further value corresponding to the difference between the first distance and a second distance from a detection mark to a leading edge of each label is also stored in the memory, the control means being effective to first advance a leading end of the continuous paper from the pitch sensor to the printing position and then further advance the continuous paper by the distance defined by the further value.

* * * * *